United States Patent [19]

Hammer et al.

[11] Patent Number: 4,468,591

[45] Date of Patent: Aug. 28, 1984

[54] SHAPED DISCHARGE LAMP WITH STARTING AID AND STARTING STRIP

[75] Inventors: Edward E. Hammer, Mayfield Village; Charles E. Beck, Chesterland, both of Ohio

[73] Assignee: General Electric Company, Schenectady, N.Y.

[21] Appl. No.: 368,500

[22] Filed: Apr. 15, 1982

[51] Int. Cl.[3] ..... H01J 61/30; H01J 61/54

[52] U.S. Cl. ..... 313/594; 313/634

[58] Field of Search ..... 313/594, 601, 602, 634, 313/234, 607, 492, 596

[56] References Cited

U.S. PATENT DOCUMENTS 2,795,724 6/1957 Beeson ..... 313/594
3,548,241 12/1970 Rasch et al. ..... 313/490 X
4,138,621 2/1979 Downing et al. ..... 313/113
4,321,502 3/1982 Hammer et al. ..... 313/594
4,422,010 12/1983 Hammer ..... 313/634 X

*Primary Examiner*—David K. Moore
*Assistant Examiner*—K. Wieder
*Attorney, Agent, or Firm*—Philip L. Schlamp; Fred Jacob

[57] ABSTRACT

A discharge lamp comprising an elongated bulb shaped so that the ends thereof are substantially closer together than if the bulb were straight and containing electrodes respectively near said ends thereof, a starting aid comprising electrically interconnected conductive members respectively adjacent to said bulb behind the plane of each of said electrodes, and a conductive material extending continuously along a portion of said bulb and having ends terminating in front of the plane of each electrode.

9 Claims, 9 Drawing Figures

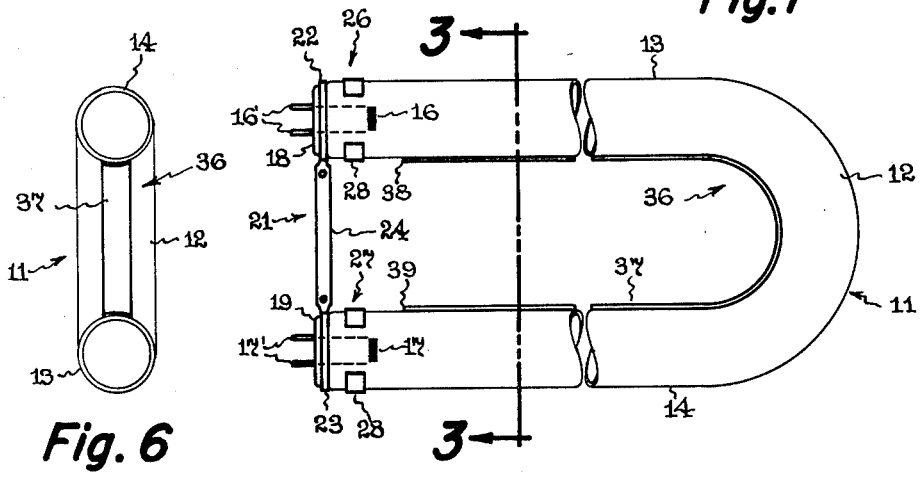
Fig. 1
Fig. 6
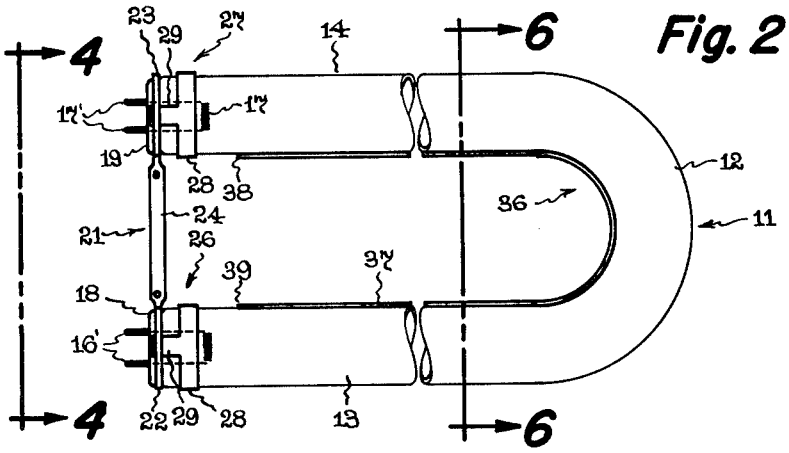
Fig. 2
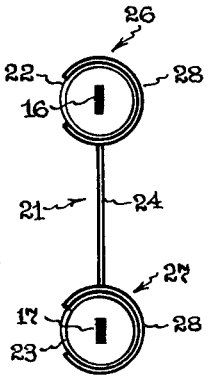
Fig. 3
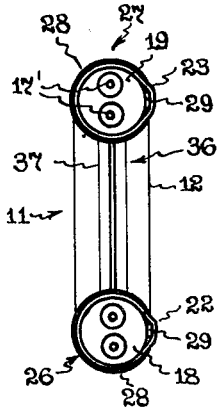
Fig. 4
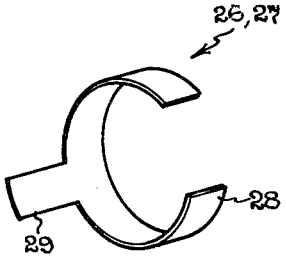
Fig. 5

SHAPED DISCHARGE LAMP WITH STARTING AID AND STARTING STRIP

CROSS-REFERENCE TO RELATED APPLICATIONS

Ser. No. 253,089, filed Apr. 13, 1981, now abandoned, Edward E. Hammer, "U-Shaped Discharge Lamp with Starting Aid," assigned the same as this invention.

Ser. No. 368,498, filed concurrently herewith, Edward E. Hammer and Charles E. Beck, "Shaped Discharge Lamp with Starting Aid," assigned the same as this invention.

Ser. No. 368,498, filed concurrently herewith, Edward E. Hammer and Charles E. Beck, "Starting Aid for Discharge Lamp," assigned the same as this invention.

BACKGROUND OF THE INVENTION

The invention is in the field of discharge lamps, such as fluorescent lamps, having an elongated bulb shaped so that its ends are substantially closer together than if the bulb were straight, and containing electrodes near the ends of the bulb. Examples of such lamps are U-shaped lamps, circular lamps, double spiral lamps, and half-circle lamps.

U.S. Pat. No. 3,548,241 to Rasch discloses a U-shaped fluorescent lamp construction of the type having a support strap clamped around the ends of the lamp to improve its rigidity. The lamp does not employ a starting aid.

The above-referenced patent application to Hammer is directed to U-shaped discharge lamps having conductive starting aid members respectively adjacent to the lamp bulb in the vicinity of its electrodes, and means electrically interconnecting the starting aid members. It has been known that fluorescent lamp starting is improved by providing a conductive coating or a conductive stripe along the bulb from near one cathode to the other, and also by installing the lamps near to (¼" or ½") an electrically conductive reflector fixture.

SUMMARY OF THE INVENTION

Objects of the invention are to provide means for improving the starting of U-shaped lamps and other discharge lamps having an elongated bulb shaped so that its ends are substantially closer together than if the bulb were straight, and also to improve the restart capabilities of such lamps. The term "restart" means turning the lamp on quickly (within several seconds or several minutes) after it turns off. Examples are when the light switch is accidentally turned off and is quickly turned on again, and when the power line voltage dips or goes off momentarily. Another object is to provide a shaped discharge lamp having improved starting characteristics without the benefit of a nearby metal reflector or fixture.

The invention comprises, briefly and in a preferred embodiment, a discharge lamp comprising an elongated bulb shaped so that its ends are substantially closer together than if the bulb were straight and containing electrodes respectively near the ends thereof, and a starting aid comprising a pair of conductive means respectively adjacent to said bulb in the vicinity of and preferably behind the plane of said electrodes, spacially extending means electrically interconnecting said conductive means, and conducting means extending continuously along a portion of said bulb and terminating in front of the plane of each electrode. The aforesaid interconnecting means may be, or may be combined with, a bulb support strap attached to and extending between the ends of the bulb. Preferably, the aforesaid conductive means at least partially encircle the bulb legs.

BRIEF DESCRIPTION OF THE DRAWINGS

FIG. 1 is a view of one side of a U-shaped discharge lamp in accordance with a preferred embodiment of the invention.

FIG. 2 is a view of the other side of the lamp of FIG. 1.

FIG. 3 is a cross-sectional view taken on the line 3—3 of FIG. 1.

FIG. 4 is a cross-sectional view taken on the line 4—4 of FIG. 2.

FIG. 5 is a perspective view of a starting aid clip used in a preferred embodiment of the invention, two such clips being employed on a lamp.

FIG. 6 is a cross-sectional view taken on the line 6—6 of FIG. 2.

DESCRIPTION OF THE PREFERRED EMBODIMENTS

Figure 7:
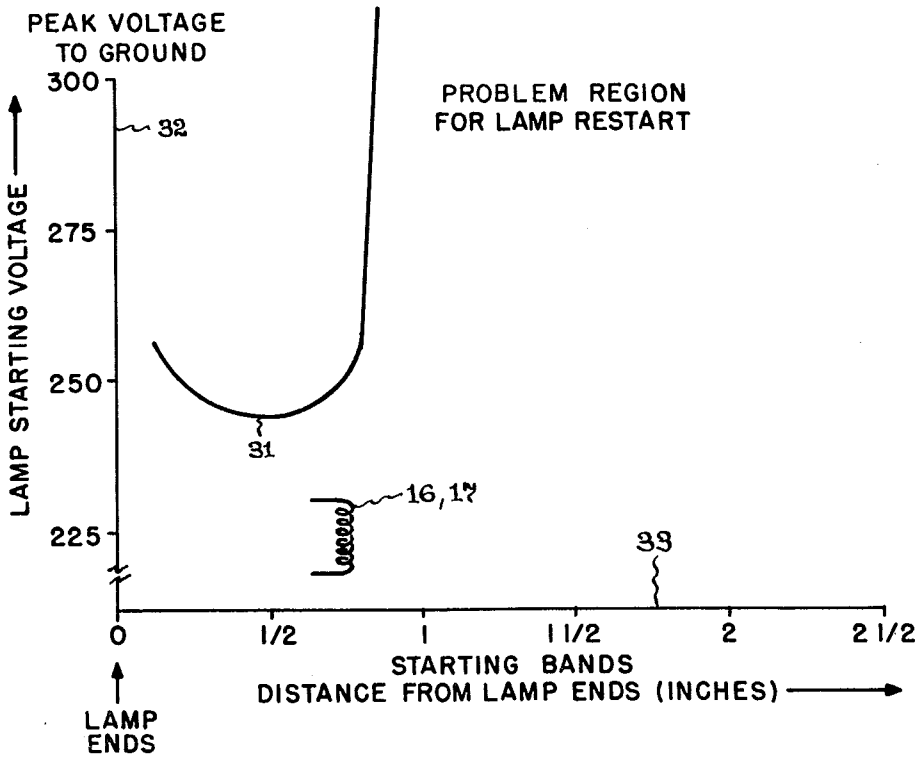
FIG. 7 is a plot representing lamp starting voltages of a U-shaped lamp with the conductive starting strip of the invention terminating at various positions along the bulb.

The U-shaped discharge lamp of FIG. 1 comprises a U-shaped bulb 11 having a U-bend portion 12 and a pair of mutually parallel straight legs 13, 14. A pair of cathodes 16 and 17 are respectively mounted in the bulb near the ends thereof, and respectively connected to pairs of the lamp's connector terminals 16' and 17'. A pair of short cylindrical metal end caps 18 and 19 are cemented to the ends of the bulb for supporting the connector terminals 16' and 17' by means of an insulative mounting disc in conventional manner. The endmost regions of the bulb 11, over which the end caps 18, 19 fit, conventionally are "necked down" slightly in diameter from that of the rest of the bulb. In order to mutually brace the ends of the bulb 11, a support strap 21 is provided and comprises circular metal bands 22, 23 respectively tightly encircling the end caps 18 and 19, these bands 22 and 23 being attached to and interconnected by a rigid metal lateral strap 24. The lamp described thus far is generally similar to that disclosed in the above-referenced Rasch patent. Conventionally, bulb 11 is internally coated with a phosphor, and contains a quantity of mercury to provide a mercury vapor discharge path in the lamp. Also, a gas fill such as argon is provided in the bulb to aid in starting, or in more recent energy-saving lamps the fill gas is a mixture of krypton and argon.

A starting aid for the lamp comprises a pair of electrically conductive members 26, 27 respectively adjacent to the bulb in the vicinity of and preferably behind the plane of the lamp's cathode electrodes 16, 17, i.e., between the planes of the cathodes and the ends of the bulb at which end caps 18, 19 are attached, this being the subject of the above-referenced patent application Ser. No. 368,498. In a preferred embodiment, each of the starting aid conductive members 16, 17 comprises a circular band portion 28 which at least partly surrounds and encircles the bulb and preferably is in contact therewith. The band portions 28 preferably extend at least halfway around the bulb circumference, and may comprise closed loops completely encircling the bulb. The starting aid members 26, 27 are electrically interconnected by spatially extending conductive means, rather than by conductive means extending alongside a major portion of the bulb length. A preferred type of this spatially extending electrical interconnection, which is the subject of the above-referenced patent application Ser. No. 368-499, comprises extension stems 29 integral with and extending from the respective band portions 28; these stems 29 extend respectively under the bracing bands 22, 23 and are securely clamped between these bands and the end caps 18, 19 thus electrically interconnecting the starting aid members 26, 27 via the metal bracing bands 22, 23 and lateral strap 24. The conductive bands 26, 27 may be made of resilient metal so that they clamp snugly onto the bulb, and alternatively, they and their extending stems 29 can be applied to the bulb in the form of a conductive ink or paint with the stems 29 extending under and contacting the end caps 18, 19.

As has been mentioned above, the abovereferenced patent application of Hammer is directed to a U-shaped discharge lamp having electrically interconnected conductive starting aid members respectively at or adjacent to the lamp bulb in the vicinity of the electrodes. These starting aid members, in being in the vicinity of the lamp electrodes, can lie in the plane in which the electrodes lie, or can be ahead of the plane of the electrodes (i.e., at the gas discharge region of the bulb) or behind the plane of the electrodes (i.e., between the plane of the electrodes and the ends of the bulb) up to distances within which they achieve the objective of aiding lamp starting. However, the starting aids improve restart of the lamps only if they are located behind the plane of the lamp electrodes, and can hinder or prevent restart of the lamps if located ahead of the plane of the electrodes. "Restart" is a condition when the lamp is to be restarted shortly (within several seconds or minutes) after it has turned off, such as when the light switch is accidentally or otherwise turned off and is quickly turned on again within a few minutes, or when the power line voltage momentarily dips or goes off. Therefor the starting aids preferably are located behind the plane of the electrodes and in this position they aid and facilitate restart of the lamps and also aid and facilitate initial start of the lamps. The term "initial start" as used herein means starting the lamp after it has been off for a considerable time such as more than several minutes.

FIG. 7 illustrates the just-described restarting characteristics of lamps provided with starting aids, and is a plot 31 of lamp restart voltage as represented along the vertical coordinate 32 versus location of the starting aids along the legs of the U-shaped bulb as represented along the horizontal coordinate 33. In a typical 35-watt U-shaped lamp, which generally is 22 inches long from its ends to its U-bend, the cathode electrodes 16, 17 are positioned $\frac{3}{4}$ inch from the lamp ends, as indicated in FIG. 6. The restart voltage coordinate 32 is marked with "Peak Voltage to Ground" which is the peak value of ac starting and restarting voltage applied by the ballast to the lamp electrodes 16, 17.

As shown by the plot 31, the lamp restarts the most readily and reliably, i.e., at the lowest applied voltage, when the starting aid bands 28 are positioned behind the plane of the electrodes 16, 17 and is optimum when the starting bands 28 are about $\frac{1}{4}$ to $\frac{3}{8}$ inch behind the plane of the electrodes. Also, curve 31 shows an abrupt occurrence of a restart problem if the starting bands 28, or any part of them, are positioned ahead of the plane of the electrodes. Thus, locating the starting aid bands 28 behind the plane of the electrodes provides beneficial restart characteristics, in addition to providing beneficial initial start characteristics by being in the vicinity of the electrode plane.

The theory of the foregoing operation is believed to be as follows. During lamp operation, the starting aid members 26, 27 (and the interconnecting support strap 21), which are electrically floating, acquire a negative polarity charge due to the electron emissions which alternately occur from the cathodes 16, 17 in functioning to sustain an ac gas discharge current in the lamp. When the lamp is turned off, this negative charge remains on the members 26, 27 for a time until it dissipates or drains off, usually during a period of several seconds or minutes, this time depending on conditions of the lamp and surrounding air; if the glass bulb is clean and the air is dry the time will be relatively long, and if the bulb is dirty and/or moist and the air is humid the time will be relatively short. If it is attempted to turn the lamp on during this time period of residual negative charge of the starting aid bands 26, 27, and if these bands are positioned ahead of the electrodes 16, 17, the lamp may not restart until the negative charge on the starting aid bands dissipates or drains off. This undesired delay in restart is indicated by the "Problem Region for Lamp Restart" in FIG. 6, and is probably due to the negative charge of the starting bands repelling electrons emitted from the electrodes 16, 17 and preventing them from entering the gas discharge region sufficiently to initiate a gas discharge for restarting the lamp. When, however, the starting aid bands 26, 27 are positioned behind the plane of the electrodes, the lamp restarts readily and the restart is actually facilitated because the negative charge of the starting aid bands repels electrons emitted from the electrodes 16, 17 in directions toward the gas discharge region, thus facilitating establishment of the gas discharge and hence starting of the lamp. The starting aid bands 26, 27 may be, for example, about $\frac{1}{4}$- to $\frac{3}{8}$-inch wide and positioned about $\frac{1}{4}$ to $\frac{1}{2}$ inch behind the plane of the electrodes 16, 17.

Figure 8:
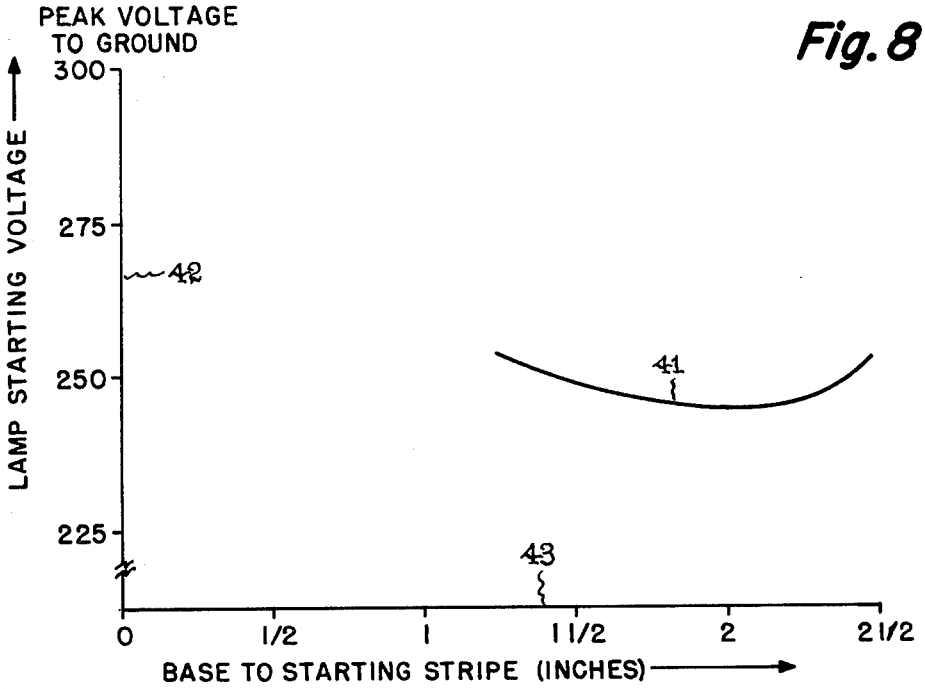
FIG. 8 is a plot representing lamp starting voltages of lamps with, and without, the starting strip of the invention, at various spacings of the lamps from a metal fixture.

In accordance with the present invention, the starting ability of the lamp is further improved by adding an electrically conductive means 36 to the bulb, such as in the form of a coating of transparent conductive material such as tin oxide, or a strip or stripe 37 of conductive ink or paint or of metallized plastic, coated on or adhered to the bulb and extending continuously along a portion of the bulb length and terminating at ends 38, 39 which are spaced from and are not connected to the starting aids 26, 27. The stripe 37 is shown positioned against the inner side surface of the lamp, which is a preferred position because the stripe is shortest and is more protected in this position; however the invention is not limited to this particular positioning of the stripe. The spacing between the stripe ends 38, 39 and the starting aid bands 26, 27 is critical for obtaining the best, i.e. easiest, starting conditions of the lamp. For example, FIG. 8 shows a plot 41 of starting and restarting voltage, the vertical scale 42 being peak voltage to ground and the horizontal scale 43 being the distance of the stripe ends 38, 39 from the base ends of the lamp bulb. Curve 41 of FIG. 8 was plotted by testing the same basic type of 35-watt Mod-U-Line lamp, using the same type of ballast, and with the lamps mounted ¼ inch from a conductive reflector, as for plotting the curve 31 of FIG. 7 which shows the best starting and restarting (lowest voltage), occurs when the starting aid bands 26, 27 are about ½ inch from the lamp ends (and ¼ inch behind the cathodes 16, 17), this best and lowest voltage being about 245 volts. The curve 41 of FIG. 8 was plotted from lamps having starting aids 26, 27 at the optimum ½ inch distances from the lamp ends (as determined from FIG. 7); starting stripes 36 of different lengths were applied to the bulbs, and voltage of increasing value was applied to the lamps to start them. Curve 41 shows that the best starting (lowest voltage) occurs when the ends 38, 39 of the stripe 36 are about 2 inches from the bulb ends (and about 1¼ inches from the cathodes 16, 17), this best starting voltage being the same value of 245 volts as for curve 31 in FIG. 7.

Figure 9:
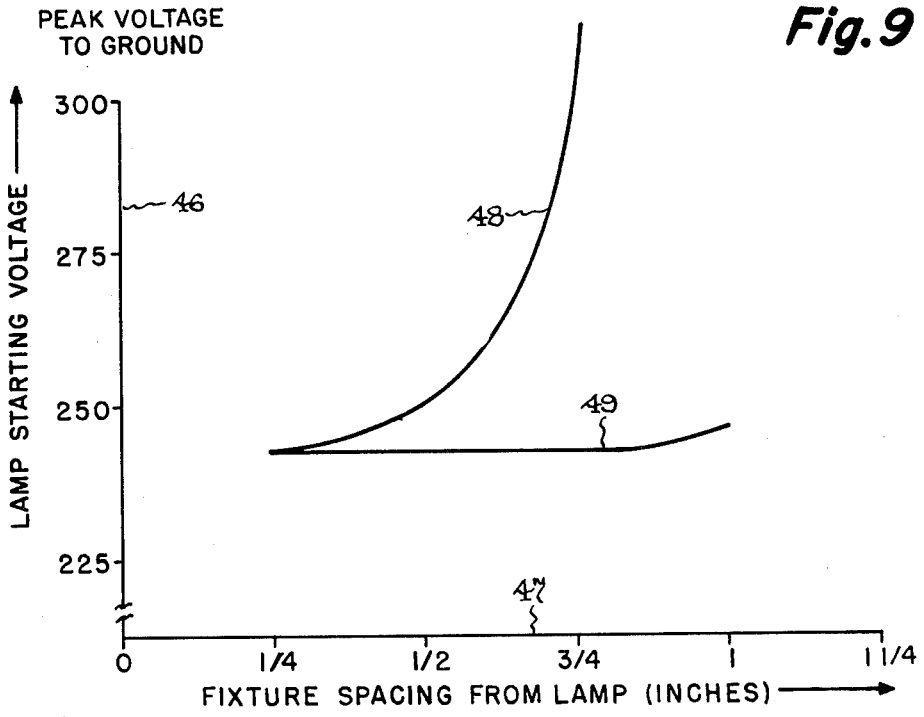
FIG. 9 is a plot representing lamp starting voltage at various distances of the lamp from a conductive reflector for a prior art lamp and a lamp built according to the present invention.

The principal advantage of the invention is shown in FIG. 9, which is a plot of lamp starting voltage (vertical line 46) vs. distance of the lamp from a conductive reflector of a fixture (horizontal line 47), and in which curve 48 is a plot of starting voltage of a lamp having optimized starting aid bands 26, 27 as determined from curve 31 in FIG. 7 (but not having a starting stripe 36), and curve 49 is a plot of starting voltage of a similar lamp to which was added a starting stripe 36 ending 2 inches from the bulb ends and thus optimized per curve 41 of FIG. 8. As shown by the curves 48 and 49, both lamps started equally well (245 volts) at a spacing of ¼ inch from the conductive reflector. However, the prior art lamp, represented by curve 48, required greatly increased starting voltage as it was moved farther from the reflector, and starting became unfeasible at distances beyond ⅝ inch. The lamp of the present invention, represented by curve 49, did not experience an appreciable rise in required starting voltage until the fixture spacing exceeded one inch, and the rise was gradual beyond that. Thus the invention, by providing lamps that start easily in fixtures having a conductive reflector spaced considerably from the lamp, and fixtures not having a conductive reflector, achieves proper lamp operation in differing fixtures of various manufacturers, and permits greater latitude in reflector configuration for achieving various desired reflected light patterns.

The starting aid and stripe combination of the invention can be used advantageously on various types of discharge lamps which have an elongated bulb shaped so that its ends are substantially closer together than if the bulb were straight. Although the invention has been particularly described as applied to a U-shaped lamp bulb, it can similarly be applied to a circular bulb having its ends relatively close together, and to bulbs having a semi-circular shape, and also bulbs having a double-spiral configuration, and other bulbs shaped to have their ends substantially closer together than if the bulbs were straight. The invention is particularly useful on high efficiency discharge lamps containing krypton gas which causes the lamps to be more difficult to start and restart.

While preferred embodiments and modifications of the invention have been shown and described, various other embodiments and modifications thereof will become apparent to persons skilled in the art and will fall within the scope of the invention as defined in the following claims.

What we claim as new and desire to secure by Letters Patent of the United States is:

1. A discharge lamp comprising an elongated bulb shaped so that its ends are substantially closer together than if the bulb were straight and containing electrodes respectively near said ends thereof, a starting aid comprising a pair of conductive means each disposed adjacent to a respective end of said bulb and behind the plane of said electrodes with respect to the discharge path, spatially extending means electrically interconnecting said conductive means, and a conductive member comprising a stripe extending continuously along a portion of said bulb and terminating in spaced relationship to said starting aid conductive means and ahead of the plane of said electrodes with respect to the discharge path.

2. A lamp as claimed in claim 1, in which said bulb is U-shaped and having a pair of parallel legs, and in which said interconnecting means comprises a conductive member extending between said pair of parallel legs near said ends thereof.

3. A lamp as claimed in claim 2, in which said conductive member comprises a stripe along the inner surface of said bulb.

4. A lamp as claimed in claim 2, in which said lamp includes a support means extending across the ends of the bulb, said support means comprising said interconnecting means.

5. A lamp as claimed in claim 4, in which said starting aid conductive means comprises a pair of conductive bands respectively extending around at least part of the circumference of said bulb, and in which said support means comprises a pair of bracing bands respectively encircling the end regions of said bulb, said starting aid bands comprising extension stems respectively extending beneath and clamped by said bracing bands.

6. A lamp as claimed in claim 1, in which said starting aid conductive means comprises a pair of conductive bands respectively extending around at least half of the circumference of said bulb.

7. A lamp as claimed in claim 1, in which said lamp is provided with a gas fill comprising krypton.

8. A lamp as claimed in claim 7, in which said gas fill further comprises argon and mercury.

9. A lamp as claimed in claim 1, in which the ends of said conductive member are spaced approximately one to two inches from the planes of said electrodes.

* * * * *